US008573725B2

(12) United States Patent
Snyder et al.

(10) Patent No.: US 8,573,725 B2
(45) Date of Patent: Nov. 5, 2013

(54) SYSTEM AND METHOD FOR CORRECTING STITCH ERROR IN A STAGGERED PRINTHEAD ASSEMBLY

(75) Inventors: Trevor James Snyder, Newberg, OR (US); Jignesh P. Sheth, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 552 days.

(21) Appl. No.: 12/857,333

(22) Filed: Aug. 16, 2010

(65) Prior Publication Data

US 2012/0038697 A1 Feb. 16, 2012

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS

| | | | | |
|---|---|---|---|---|
| 4,238,804 | A | 12/1980 | Warren | |
| 4,255,754 | A | 3/1981 | Crean et al. | |
| 4,410,895 | A | 10/1983 | Houston et al. | |
| 6,268,933 | B1 | 7/2001 | Kim | |
| 6,357,847 | B1 | 3/2002 | Ellson et al. | |
| 6,798,920 | B1 | 9/2004 | Wells et al. | |
| 6,984,013 | B2 | 1/2006 | Arqullevich et al. | |
| 7,742,713 | B2 | 6/2010 | Mizes et al. | |
| 2003/0016263 | A1 * | 1/2003 | Takahashi et al. | 347/19 |
| 2005/0083364 | A1 * | 4/2005 | Billow | 347/19 |
| 2006/0144282 | A1 * | 7/2006 | Casey | 104/53 |
| 2008/0284804 | A1 | 11/2008 | Seccombe | |

* cited by examiner

*Primary Examiner* — Laura Martin
(74) *Attorney, Agent, or Firm* — Maginot, Moore & Beck, LLP

(57) ABSTRACT

An improved method of measuring relative positions of adjacent printheads in a printhead array has been developed. A pair of ink dashes is made with different colors of ink from adjacent printheads and an offset distance between the dashes is determined from color density measurements of the two dashes. The offset distance may then be used to adjust the stitch alignment of the two printheads.

12 Claims, 5 Drawing Sheets

SYSTEM AND METHOD FOR CORRECTING STITCH ERROR IN A STAGGERED PRINTHEAD ASSEMBLY

TECHNICAL FIELD

This disclosure relates generally to imaging devices having staggered full width printhead assemblies, and more particularly, to the correction of stitch errors in such imaging devices.

BACKGROUND

Some ink printing devices use a single printhead, but many use a plurality of printheads to increase the rate of printing. For example, four printheads may be arranged in two rows with each row having two printheads. The two printheads in the first row are separated by a distance corresponding to the width of a printhead. The first printhead in the second row is positioned at a location corresponding to the gap between the two printheads in the first row and the last printhead in the second row is separated from the first printhead in the second row by a distance corresponding to the width of a printhead. This arrangement is called a staggered full width array (SFWA) printhead assembly and an embodiment of a SFWA assembly is shown in FIG. 5.

Synchronizing the passage of an image receiving member with the firing of the inkjets in the printheads enables a continuous ink image to be formed across the member in the direction perpendicular to the direction of member passage. Alignment of the ink drops ejected by the printheads, however, may not be as expected. Each printhead in the SFWA has six degrees of positional freedom, three of which are translational and three of which are rotational. The printheads need to be precisely aligned to provide a smooth transition from the ink drops ejected by one printhead to the ink drops printed by the other printheads in the assembly. Misalignment of printheads may occur from, for example, printheads failing to meet manufacturing tolerances, thermal expansion of the printhead and associated parts of the printer, vibration of the printhead, or the like.

Misalignments between printheads in three of the six degrees of freedom may be categorized as roll or stitch errors. Roll errors can occur when a printhead rotates about an axis normal to the imaging member. Roll error causes a skew in the rows of ink drops ejected by the printhead relative to the imaging member. This skew may be noticeable at the interface between two printheads and may cause an objectionable streak. Stitch errors occur from shifts in one printhead compared to another printhead. Y-axis stitch errors arise from shifts that cause ink drop rows from the shifted printhead to land above or below the ink drop rows ejected by preceding or following printhead. X-axis stitch errors arise from shifts that cause the first and last drops in the rows printed by the shifted printhead to be too close or too far from the last and first drops, respectively, in the rows printed by the preceding and following printheads, respectively. Of course, if the shifted printhead is the first or last printhead in the assembly, shifting of the first drop or the last drop in the rows, respectively, does not occur at an intersection with another printhead. Thus, aligning printheads in a SFWA with sufficient accuracy to allow high image quality is desired.

SUMMARY

An improved method of measuring relative positions of adjacent printheads in a printhead array has been developed.

The method includes ejecting at least one ink drop of an ink having a first color from an ink ejector in a first printhead onto an image receiving surface, the ink ejector in the first printhead being a last ink ejector in the first printhead in a cross-process direction, ejecting at least one ink drop of an ink having a second color from an ink ejector in a second printhead onto the image receiving surface, the ink ejector in the second printhead being a first ink ejector in the second printhead in the cross-process direction and the first and second printheads being adjacent printheads in a printhead array in the cross-process direction, generating color image data of the at least one ink drop having the first color and the at least one ink drop having the second color, identifying a color density of a secondary color in the color image data, the secondary color corresponding to a color of a mixture of the at least one ink drop having the first color and the at least one ink drop having the second color, and moving one of the first printhead and the second printhead in a cross-process direction in response to the identified color density being less than a predetermined threshold color density.

A printer is configured to use an improved method of measuring relative positions of adjacent printheads in a printhead array. The printer includes an imaging member having an image receiving surface, a printhead array including a first printhead and a second printhead, the first printhead having a plurality of ink ejectors, the second printhead having a plurality of ink ejectors, the first printhead and second printhead configured to eject ink drops on the image receiving surface, and the first and the second printheads being adjacent printheads in the printhead array in a cross-process direction, an optical detector configured to generate color image data from detected light reflected from ink on the image receiving surface, a controller operationally coupled to the first printhead, second printhead, and optical detector, the controller configured to operate the first printhead to eject at least one ink drop of an ink having a first color from an ink ejector in the first printhead onto the image receiving surface, the ink ejector in the first printhead being a last ink ejector in the first printhead in a cross-process direction, operate the second printhead to eject at least one ink drop of an ink having a second color from an ink ejector in the second printhead onto the image receiving surface, the ink ejector in the second printhead being a first ink ejector in the second printhead in the cross-process direction, receive color image data generated by the optical detector corresponding to the at least one ink drop having the first color and the at least one ink drop having the second color, identify a color density of a secondary color in the color image data, the secondary color corresponding to a color of a mixture of the at least one ink drop having the first color and the at least one ink drop having the second color; and move one of the first printhead and the second printhead in a cross-process direction in response to the identified color density being less than a predetermined threshold color density.

A system is configured to evaluate printhead position in an ink printing system. The system includes a first printhead having a last ink ejector and a second printhead having a first ink ejector, the first and second printheads positioned adjacent to one another in a cross-process direction and configured to eject ink drops onto an image receiving surface, where ejected ink drops from the last ink ejector of the first printhead form a first ink dash having a first color and ejected ink drops from the first ejector of the second printhead form a second ink dash having a second color, and a controller operatively coupled to at least the first printhead and the second printhead, the controller configured to operate the first printhead to form the first dash on the image receiving surface, and operate the second printhead to form the second dash on the image receiving surface at a process direction position corresponding to a process direction position of the first dash to enable an offset distance between the first and the second printheads to be detectable from the first and second dashes formed on the image receiving surface.

A method has also been developed that enables adjacent printhead alignment using a pair of dashes made from the same color ink ejected from two adjacent printheads. The method includes ejecting at least one ink drop from an ink ejector in a first printhead onto an image receiving surface, the ink ejector in the first printhead being a last ink ejector in the first printhead in a cross-process direction, ejecting at least one ink drop from an ink ejector in a second printhead onto the image receiving surface, the ink ejector in the second printhead being a first ink ejector in the second printhead in the cross-process direction and the first and second printheads being adjacent printheads in a printhead array in the cross-process direction, identifying an offset distance between the two ink drops ejected from the first and second printheads, and moving one of the first printhead and the second printhead in a cross-process direction in response to the offset distance being at least a predetermined distance.

BRIEF DESCRIPTION OF THE DRAWINGS

The foregoing aspects and other features of a system and method that provide an improved method of stitch alignment in a printing system employing multiple printheads are explained in the following description, taken in connection with the accompanying drawings.

DETAILED DESCRIPTION

Figure 1:
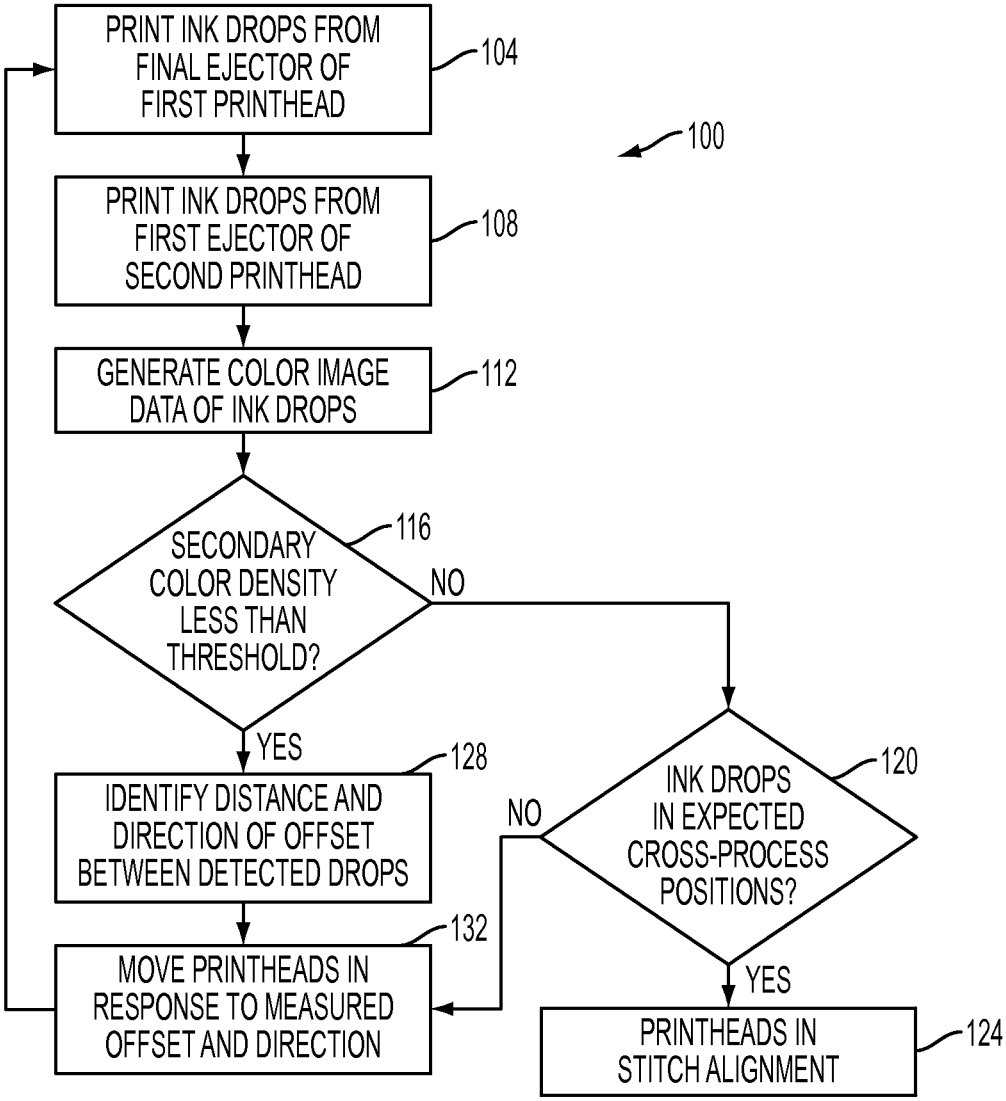
FIG. 1 is a block diagram of a process for measuring the cross-process distance between adjacent printheads in a printhead array, and for moving the printheads in the cross-process direction.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, or the like. Also, the description presented below is directed to a system for operating a printer that forms images on a moving web driven by rollers. Also, the word "component" refers to a device or subsystem in the web printing system that is operated by a controller in the web printing system to condition the web, print the web, or move the web through the web printing system. A "process direction" refers to a direction in which an imaging member in a printer moves during a print imaging operation. A "cross-process direction" is a perpendicular direction from the process direction along the surface of the imaging member. As used in this document, "identify" and "calculate" include the operation of a circuit comprised of hardware, software, or a combination of hardware and software that reaches a result based on one or more measurements of physical relationships with accuracy or precision suitable for a practical application. As used in this document, a "dash" refers to a predetermined number of ink drops ejected by an inkjet ejector in the process direction onto an image receiving substrate. A group of dashes printed by different ejectors form a test pattern. Image data corresponding to this test pattern may then be generated and analyzed to identify positions of the inkjet ejectors and printheads. Dashes that are adjacent but separated from each other in the cross-process direction or that overlap one another in the cross-process direction enable a color value to be established from the image data if each dash is a different color. Overlapping pairs of dashes, for the purpose of the present alignment method, are formed with different colors of ink but they may be formed with the same color of ink provided appropriate optical viewing techniques are used. Multiple pairs of dashes with varying or incremental offset distances between the dashes enable improved detection of misalignment.

Figure 5:
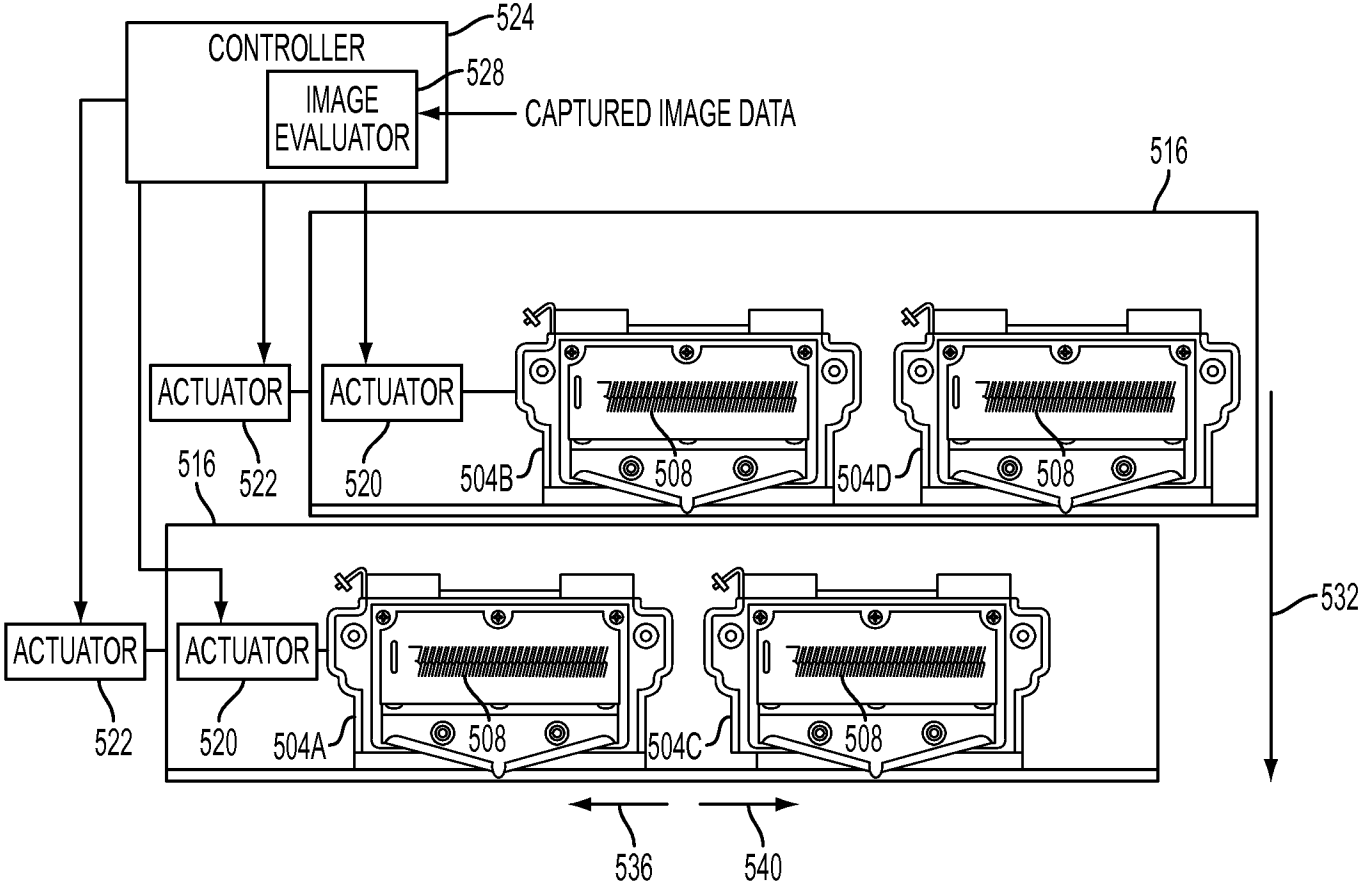
FIG. 5 PRIOR ART
FIG. 5 is a schematic diagram of a prior art SFWA printhead assembly.

Referring to FIG. 1, a process 100 for a printer to determine the relative positions of inkjet printheads in a cross-process direction is depicted. Process 100 begins by having a first printhead in a printhead array eject ink drops onto an imaging member, such as an imaging drum or imaging belt (block 104). The first printhead ejects ink of a selected color onto the imaging drum from a last ejector located at an extreme end of the first printhead. While the first printhead is ejecting ink drops, a second adjacent printhead is ejecting ink drops of a different color of ink from a first ejector located at an extreme end of the second printhead proximate to the first printhead in the cross-process direction (block 108). Examples of first and second printheads in a printhead array include the pairings of printheads 504A and 504B, 504B and 504C, and 504C and 504D from FIG. 5. Each of these printheads has an ink ejector array 508 with first ejectors at the end of each ejector array 508 in cross-process direction 536 and last ejectors at the end of each ejector array 508 in cross-process direction 540. The printhead array is configured to eject ink drops onto an imaging member that moves in process direction 532 relative to the printhead array. As used in this document, adjacent printheads are printheads that are operated to form a continuous line of ink drops in a cross-process direction. In alternative printhead arrays, any two printheads positioned adjacent to one another in the cross-process direction may be considered a first printhead and a second printhead.

Figure 3:
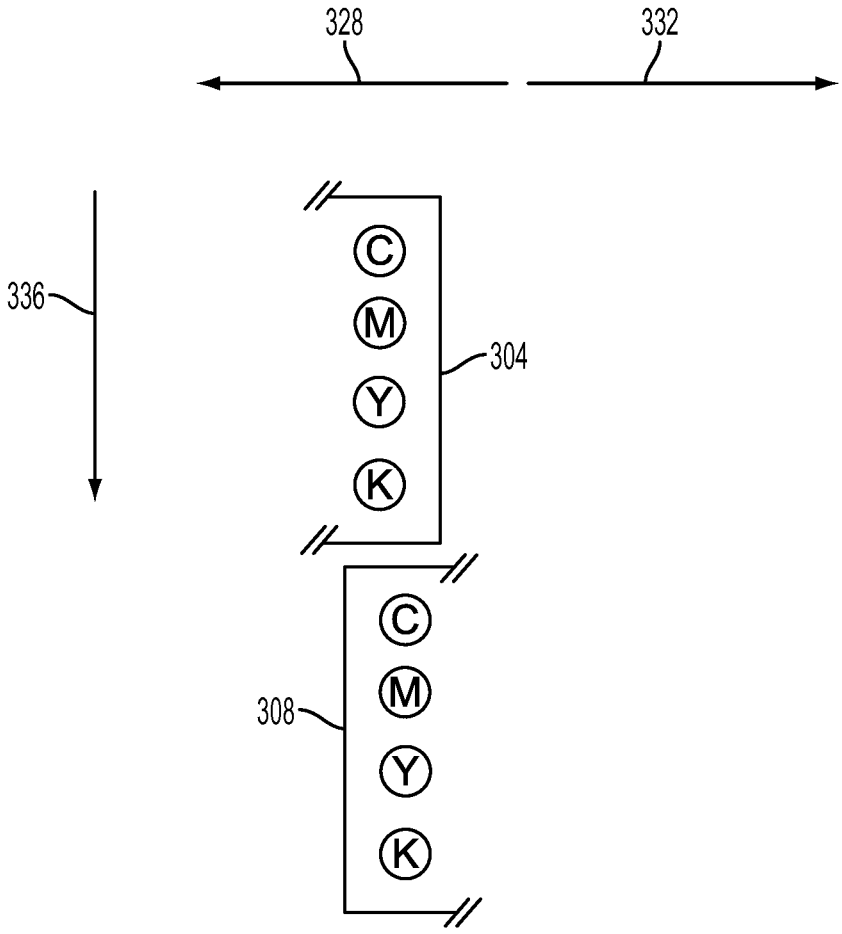
FIG. 3 is a schematic view showing stitch alignment between the final ejectors of a first printhead and initial ejectors of a second printhead.

A first and second printhead pair in stitch alignment is depicted in FIG. 3. A first printhead 304 has a final set of four inkjet ejectors, C, M, Y, and K, at its extreme end in cross-process direction 332. The ejectors correspond to ink colors, C for cyan, M for magenta, Y for yellow, and K for black. The ink drops are ejected from one of the ejectors. A second staggered printhead 308 is adjacent to the first printhead 304 in cross-process direction 332. Printhead 308 includes a first set of C, M, Y, K ejectors at an extreme end of the second printhead in cross-process direction 328. The second printhead ejects ink drops from one of its first ejectors having a different color than the final ejector emitting ink drops from the first printhead. For example, if the first printhead is emitting drops from the "C" cyan ejector, the second printhead may emit drops from the "M" magenta ejector. In FIG. 3, the imaging member moves past printheads 304 and 308 in process direction 336. Thus, an ink drop ejected from printhead 304 is deposited on the image receiving surface before an ink drop ejected from printhead 308 to a location near the first ink drop on the imaging member.

The example printheads 304 and 308 of FIG. 3 are depicted as having a proper stitch alignment. Stitch alignment refers to the amount of space between ink drops ejected from ink ejectors at the extreme ends of two adjacent printheads in the cross-process direction. While the desired stitch alignment may vary based on the arrangement of printheads in a printer, the example printheads of FIG. 3 are in stitch alignment when ink drops from the first ejectors shown for printhead 308 are deposited at an offset distance, such as the one-half of a pixel width distance used to eject the ink drops from the final ejectors shown for printhead 304 in direction 332. The offset distance, described above for simplicity as one-half of a pixel, may in fact be any distance that allows measurement of the offset and is more correctly described as the pixel to pixel spacing of the printed resolution or the width of a single ink droplet. The offset distance utilized for determining alignment may be uniquely specified for each product or printhead configuration. In the example of FIG. 3, a phase-change ink drop ejected from printhead 304 lands on the surface of the imaging member first, and a second drop of a different color from printhead 308 lands on the same location of the image receiving surface second because the two printheads are arranged in a staggered configuration. A secondary color is formed by mixing two of the C, M, Y, K primary colors together. In high density regions of an ink image, including solid fills, multiple drops in the process direction tend to form a line of ink. To achieve the best image quality, the lines need to be formed uniformly. Dot position amplification refers to the increase in color-to-color mis-registration when a secondary color line is formed. This issue arises because the finite delay time affects the deposition of the ink drop pairs that form the line of secondary color. The drops of the first color tend to at least partially freeze before the drops of the second color are deposited at the locations where the drops of the first color were deposited. At the slightest positional offset from the position where the second drops land directly on the first drops, the drops of the second color appear to fall or slide to one side of the drops of the first color. This position shift amplifies any color-to-color dot position error that occurred during ejection of the ink drops of the second color. This dot position amplification enhances detection of misalignment in the process used for head to head alignment that is depicted in FIG. 1 because the amplification magnifies the head to head alignment errors. Consequently, small errors can be measured. Once the head to head alignment has been performed, the heads will likely be intentionally mis-registered during printing. Resolution, drop mass and other system variables may influence the use of or amount of intentional alignment offset. In the present configuration, one-half pixel separation is an example of an offset amount that forces the direction of the amplified error and results in a more uniform image being produced. Thus, the example of FIG. 3 employs a stitch alignment with a one-half pixel offset in the cross-process direction between the final ejectors of printhead 304 and the first ejectors of printhead 308. As FIG. 3 is an exemplary embodiment, those having ordinary skill in the art will see that stitching alignments different than the one of FIG. 3 may be selected.

Referring again to FIG. 1, after printing ink drops, process 100 continues by detecting the color profile of deposited ink drops on the image receiving surface (block 112). The detection process includes capturing light reflected from the ink drops on the image receiving surface using an optical detector. The optical detector can determine both the cross-process position of ink drops emitting the detected light, and can also distinguish between the relative magnitudes of various frequencies of light being detected. If the detected color frequencies indicated that the ink drops have coalesced to produce a predetermined secondary color (block 116) then the adjacent printheads are determined to be in proper stitch alignment with each other (block 120). An example of a secondary color produced by two primary ink colors commonly used in inkjet printers is green. A green color is produced by mixing cyan ink with yellow ink. If the wavelengths of light corresponding to "green", i.e. the wavelengths of light from a mixture of cyan and yellow ink, are detected, then the individual ink colors are mixing on the image receiving surface, and the printheads are considered to be in proper stitch alignment.

Figure 2A:
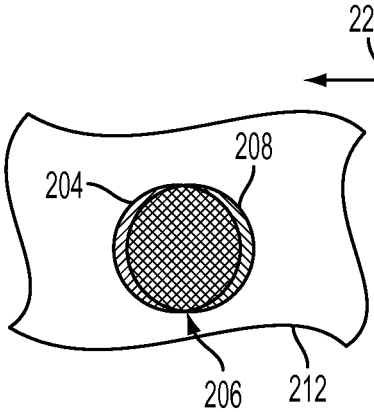
FIG. 2A is a frontal view of two ink drops of different colors partially mixed to form a third color.
Figure 2B:
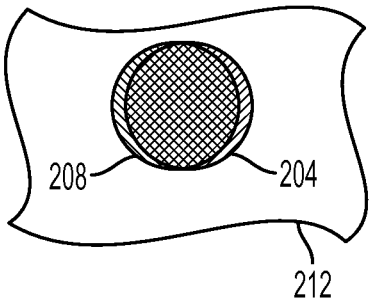
FIG. 2B is another frontal view of two ink drops of different colors partially mixed to form a third color.
Figure 2C:
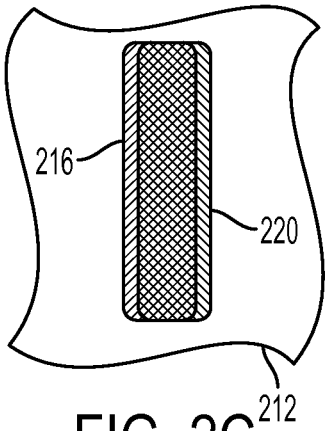
FIG. 2C is a frontal view of two ink dashes of different colors partially mixed to form a third color.
Figure 2D:
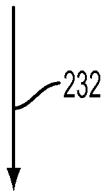
FIG. 2D is another frontal view of two ink dashes of different colors partially mixed to form a third color.
Figure 2D:
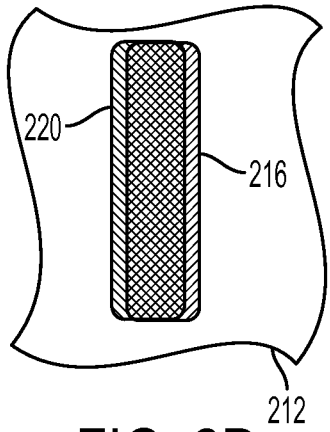

Examples of mixed ink drops formed from printheads in proper stitch alignment are seen in FIG. 2A and FIG. 2B. In FIG. 2A, the final drop from a first printhead 204 is mixed with the first drop from a second adjacent printhead 208 on an image receiving surface 212. FIG. 2B depicts the same mixed color as FIG. 2C, except that the positions of drops 204 and 208 are reversed in the cross-process direction, indicating that first ejectors of the second printhead are farther to the left (arrow 224) in the cross-process direction than the final ejectors of the first printhead. This reversed alignment does not adversely affect image quality provided that the degree of reverse overlap is very small such that the ink drops mix to form the secondary color. An alternative drop arrangement is shown in FIG. 2C and FIG. 2D. In FIG. 2C and FIG. 2D, the first and second printheads emit multiple drops to form dashes on image receiving surface 212 extending in process direction 232. Dash 216 is formed by ink drops from the final ejector in the first printhead, and dash 220 is formed by ink drops from the first ejector in the second printhead. These two dashes form a dash pair. The dashed arrangements of FIG. 2C and FIG. 2D provide an averaged color profile combining multiple drops from each of the adjacent printheads. The averaged color profile reduces spurious results that may occur if an individual ink drop suffers a random placement error.

In another embodiment, a number of lines are generated as shown in FIG. 2C or FIG. 2D, each with an intentional small incremental offset alignment value. The averaged color of each line is measured and the position of alignment is calculated by identifying the position where the lines are in proper alignment, that is, positioned directly on each other. This calculation enables noises such as drum surface, ink dye loading, drop mass and other background noises to be averaged out of the measurement effectively.

Referring again to FIG. 1, in the event that the detected color profile does not match the secondary color (block 116), the magnitude and direction of separation between ink drops from the first and second printheads is measured (block 124). When adjacent printheads are not in stitch alignment, the ejected ink drops reflect light corresponding to their individual primary colors instead of the merged secondary color. The magnitude of the separation between ink drops refers to the absolute distance between the ink drops on the image receiving surface in the cross-process direction. The optical detector may determine the magnitude of the distance by detecting a primary color and a cross-process position corresponding to a primary color of ink generated by either of the first or second printheads. The absolute difference in cross-process positions of the detected ink drops is the measured magnitude of the stitch misalignment. The magnitude of direction alone is insufficient to determine how the printheads are misaligned, since the magnitude does not convey information about whether the printheads are separated too far apart, or overlap too much in the cross-process direction. Since each printhead ejects a different color of ink, the direction of misalignment may be determined by identifying the color of each detected ink drop, and the relative positions of the ink drops along the cross-process direction.

Figure 2E:
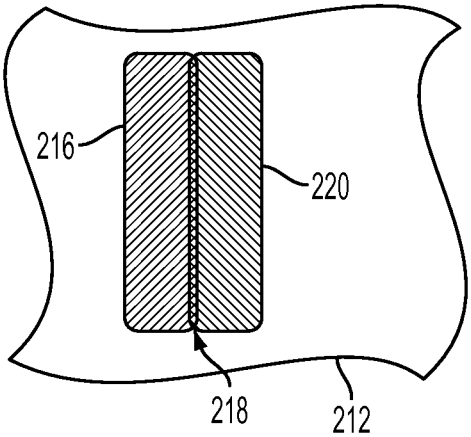
FIG. 2E is a frontal view of two ink dashes of different colors separated in a cross-process direction.
Figure 2F:
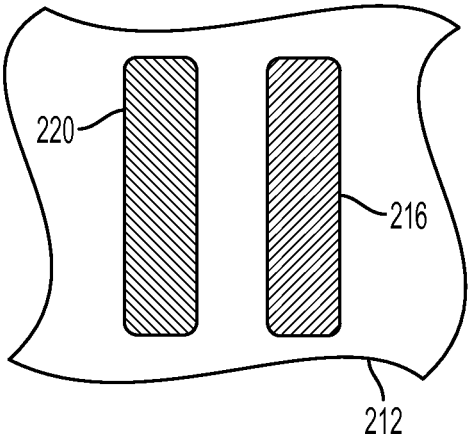
FIG. 2F is another frontal view of two ink dashes of different colors separated in a cross-process direction.

In FIG. 2E, dash 216 is generated by the final ejector in the first printhead, while dash 220 is ejected by the first ejector in the second printhead. Since dash 216 is located to the left of drop 220 in cross-process direction 224, the direction of separation between the printheads indicates that the adjacent printheads are offset by too great a distance in opposing cross-process directions, with the first printhead positioned too far in direction 224 and the second printhead positioned too far in direction 228. Conversely, in FIG. 2F dashes 216 and 220 have an offset with a similar magnitude of separation, but are in a reversed position with dash 220 to the left of dash 216 in cross process direction 224. In FIG. 2F, the relative positions of paired dashes 216 and 220 indicate that the first and second printheads have an offset that overlaps with the first printhead positioned too far in direction 228, and the second printhead positioned too far in direction 224.

Referring again to FIG. 1, in response to detecting that adjacent printheads are not in stitch alignment, one or both of the adjacent printheads may be moved in a cross process direction towards a predetermined stitch alignment (block 128). The magnitude and direction of movement is made in response to the previously determined magnitude and direction of the cross-process offset between ink drops from each of the adjacent printheads. Each printhead may be moved in a cross-process direction by an actuator such as actuators 520 from FIG. 5. An actuator is typically an electromechanical motor such as a servo mechanically coupled to a printhead such as printhead 504A and printhead 504B. In a practical embodiment, a print bar actuator is connected to a print bar containing two or more printheads. The print bar actuator is configured to reposition the print bar by sliding the print bar in the cross-process direction across the image receiving surface. Printhead actuators may also be connected to individual printheads within each of color modules 21A-21D. These printhead actuators are configured to reposition an individual printhead by sliding the printhead in the cross-process direction across the media web. The print bar actuators and printhead actuators may be servo-controlled actuators that are operatively connected to a controller that generates signals to operate the actuators to move a print bar or printhead or they may be manually adjustable mechanical actuators that may be manipulated by a tool or adjustment feature, such as thumb screw, to move a print bar or printhead. The magnitude and direction of printhead movement imparted by each actuator is controlled by an electronic control unit such as controller 524 or by manually adjusting a mechanical actuator with a tool. After moving the printheads towards the predetermined stitch alignment, process 100 optionally determines if the movement resulted in the predetermined stitch alignment by repeating the alignment process (block 104).

Figure 4:
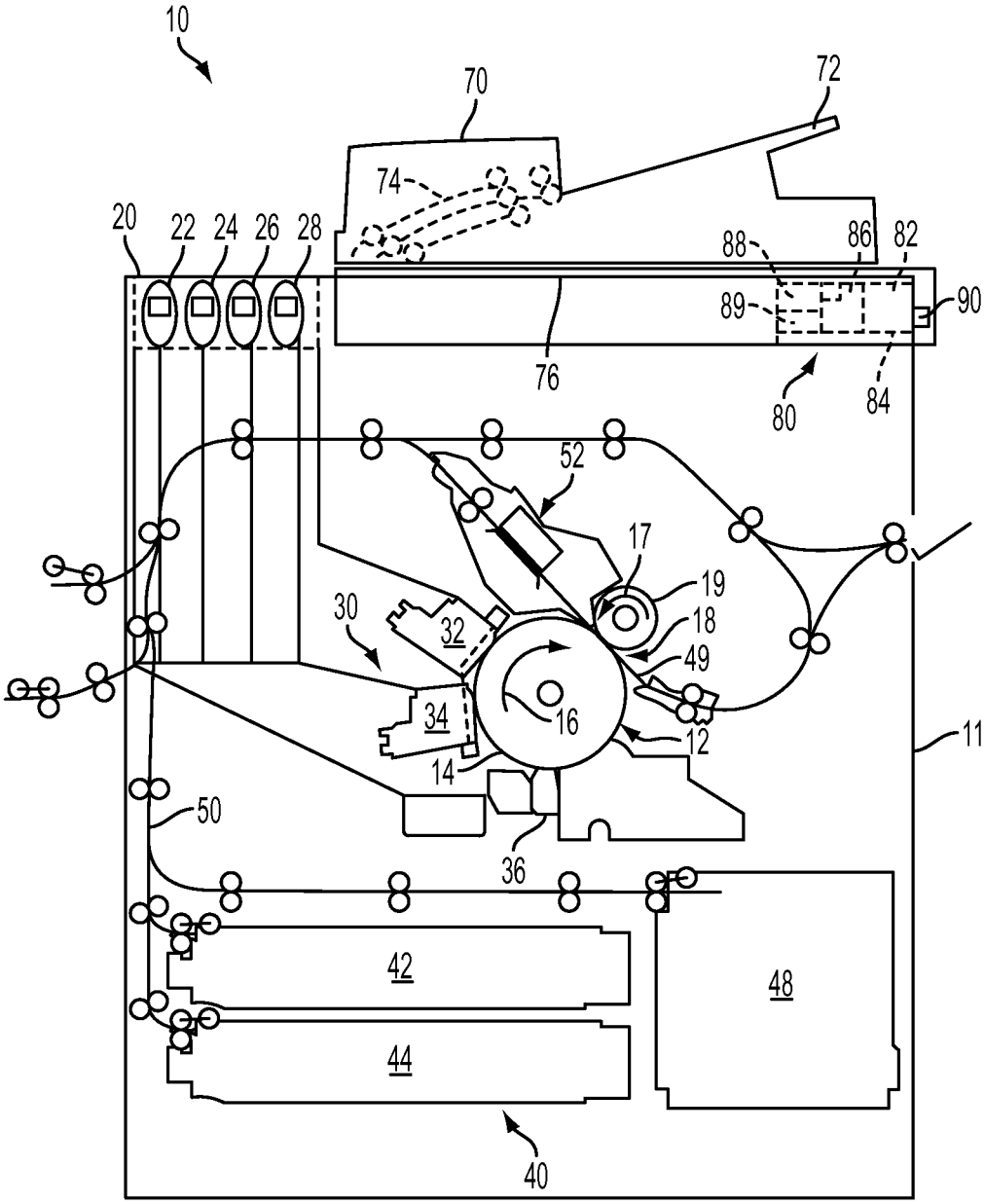
FIG. 4 is a is a block diagram of a printer depicting the components operated by a controller to detect offsets in stitch alignment between adjacent printheads and to adjust positions of printheads in a SFWA printhead assembly.

FIG. 4 depicts an embodiment of an image producing machine 10, which may be adapted to employ a stitch alignment process such as process 100. As illustrated, the machine 10 includes a frame 11 to which is mounted directly or indirectly all its operating subsystems and components, as described below. To start, the high-speed phase change ink image producing machine or printer 10 includes an imaging member 12 that is shown in the form of a drum, but can equally be in the form of a supported endless belt. The imaging member 12 has an image receiving surface 14 that is movable in the direction 16, and on which phase change ink images are formed. A transfix roller 19 rotatable in the direction 17 is loaded against the surface 14 of drum 12 to form a transfix nip 18, within which ink images formed on the surface 14 are transfixed onto a heated media sheet 49.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for supplying the liquid form to a printhead system 30 including at least one printhead assembly 32. Since the phase change ink image producing machine or printer 10 is a high-speed, or high throughput, multicolor image producing machine, the printhead system 30 includes multicolor ink printhead assemblies and a plural number (e.g., two (2)) of separate printhead assemblies 32 and 34 as shown.

As further shown, the phase change ink image producing machine or printer 10 includes a substrate supply and handling system 40. The substrate supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate handling and treatment system 50 that has a substrate heater or pre-heater assembly 52. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as an ink drop placement and control circuit 89. In addition, the CPU 82 reads, captures, prepares and manages the image data flow between image input sources, such as the scanning system 76, or an online or a work station connection 90, and the printhead assemblies 32 and 34. As such, the ESS or controller 80 is the main multi-tasking processor for operating and controlling all of the other machine subsystems and functions, including the printhead cleaning apparatus and method discussed below.

The controller 80 may be implemented with general or specialized programmable processors that execute programmed instructions, for example, printhead operation. The instructions and data required to perform the programmed functions may be stored in memory associated with the processors or controllers. The processors, their memories, and interface circuitry configure the controllers to perform the processes, described more fully below, that enable the generation and analysis of printed test strips for the generation of firing signal waveform adjustments and digital image adjustments. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

In operation, image data for an image to be produced are sent to the controller 80 from either the scanning system 76 or via the online or work station connection 90 for processing and output to the printhead assemblies 32 and 34. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, ink drop placement control is exercised relative to the imaging surface 14 thus forming desired images per such image data, and receiving substrates are supplied by any one of the sources 42, 44, 48 and handled by substrate system 50 in timed registration with image formation on the surface 14. Finally, the image is transferred from the surface 14 and fixedly fused to the image substrate within the transfix nip 18.

To evaluate the position and alignment of the printheads in a SFWA printhead assembly, the controller 80 may execute programmed instructions that enable the printer to implement a plurality of processes for generating positional correction data to address the roll and/or stitch errors, and evaluate the application of the correction data and the need to continue further error processing. In general, these processes receive captured image data of multiple ink drops or dashes deposited on an image receiving member. The controller may implement an image evaluator that processes captured image data and enables the controller to generate positional correction data for alignment of the printheads. In one embodiment, a plurality of processes implemented by a controller 80 executing programmed instructions include an image evaluator 528 (FIG. 5) used to determine stitch errors from captured image data. Controller 80 determines whether to adjust the position of one or more printheads, and to determine whether additional testing is required in response detected stitch alignment errors. One implementation of these processes is process 100, discussed above.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A system for evaluating printhead positions in an ink printing system comprising:

a first printhead having a last ink ejector and a second printhead having a first ink ejector, the first and second printheads positioned adjacent to one another in a cross-process direction and configured to eject ink drops onto an image receiving surface, where ejected ink drops from the last ink ejector of the first printhead form a first ink dash having a first color and ejected ink drops from the first ejector of the second printhead form a second ink dash having a second color; and a controller operatively coupled to at least the first printhead and the second printhead, the controller configured to:

operate the first printhead to form the first dash on the image receiving surface;

operate the second printhead to form the second dash on the image receiving surface at a process direction position corresponding to a process direction position of the first dash;

receive color image data of an area of the image receiving surface on which the first dash and the second dash were formed;

identify a color density of a secondary color in the color image data, the secondary color corresponding to a color produced by the first dash and the second dash formed on the image receiving member; and identify an offset distance between the first and the second printheads by identifying a difference between the identified color density of the secondary color and a color density for a secondary color formed by a dash of the first color and a dash of the second color being separated by a predetermined offset distance.

2. The system of claim 1 further comprising:

a first actuator coupled to the first printhead;

a second actuator coupled to the second printhead, each of the first and second actuators being configured to move the printhead coupled to the actuator in a cross-process direction; and the controller is further configured to:

operate at least one of the first and second actuators in response to the identified offset distance being below a predetermined threshold distance.

3. The system of claim 2 wherein the controller is further configured to:

identify an offset direction in the cross-process direction from the first dash with reference to the second dash in the color image data in response to the difference between the identified color density of the secondary color and the color density for a secondary color formed by a dash of the first color and a dash of the second color separated by a predetermined offset distance being at least a predetermined difference; and operate at least one of the first and second actuators in response to the identified offset direction differing from a predetermined offset direction.

4. The system of claim 1, the controller being further configured:

to identify the offset distance by identifying an average cross-process distance between the first dash and the second dash in the color image data and comparing the identified average cross-process distance to the predetermined offset distance.

5. The system of claim 1 further comprising:

a first manually adjustable mechanical actuator configured to move the first printhead; and a second manually adjustable mechanical actuator configured to move the second printhead, the manually adjustable mechanical actuators enable a position of each of the first and second printheads to be adjusted with reference to the offset distance detected between the first and the second printheads.

6. The system of claim 1 wherein the controller is further configured to:

identify the color density for the secondary color corresponding to a color produced by the first dash and the second dash formed on the image receiving member by identifying an average color value for the color formed by the first and second dashes; and identify the difference between the color densities by identifying the average color value and the color value for the secondary color formed by the dash of the first color and the dash of the second color separated by the predetermined offset distance.

7. A method of measuring positions of adjacent printheads in a printhead array comprising:

operating an ink ejector in a first printhead to form a first dash on an image receiving surface, the ink ejector in the first printhead being a last ink ejector in the first printhead in a cross-process direction;

operating an ink ejector in a second printhead to form a second dash on the image receiving surface, the ink ejector in the second printhead being a first ink ejector in the second printhead in the cross-process direction and the first and second printheads being adjacent printheads in a printhead array in the cross-process direction;

receiving color image data of an area of the image receiving surface on which the first dash and the second dash were formed;

identifying a color density of a secondary color in the color image data, the secondary color corresponding to a color produced by the first dash and the second dash formed on the image receiving member;

identifying an offset distance between the first and the second printheads by identifying a difference between the identified color density of the secondary color and a color density for a secondary color formed by a dash of the first color and a dash of the second color separated by a predetermined offset distance; and moving one of the first printhead and the second printhead in a cross-process direction in response to the offset distance being at least a predetermined distance.

8. The method of claim 7 further comprising:

operating at least one of a first actuator coupled to the first printhead and a second actuator coupled to the second printhead to move one of the first printhead and the second printhead in a cross-process direction in response to the identified offset distance being below a predetermined threshold distance.

9. The method of claim 8 further comprising:

identifying an offset direction in the cross-process direction from the first dash with reference to the second dash in the color image data in response to the difference between the identified color density of the secondary color and the color density for a secondary color formed by a dash of the first color and a dash of the second color separated by a predetermined offset distance being at least a predetermined difference; and operating at least one of the first and second actuators in response to the identified offset direction differing from a predetermined offset direction.

10. The method of claim 7, the identification of the offset distance further comprising:

identifying an average cross-process distance between the first dash and the second dash in the color image data; and comparing the identified average cross-process distance to the predetermined offset distance.

11. The method of claim 7 further comprising:

adjusting one of a first manually adjustable mechanical actuator coupled to the first printhead and a second manually adjustable mechanical actuator coupled to the second printhead to move one of the first and the second printheads with reference to the offset distance detected between the first and the second printheads.

12. The method of claim 7, the identification of the difference between the color densities further comprising:

identifying an average color value for the color formed by the first dash and the second dash formed on the image receiving member; and identifying a difference between the identified average color value and the color value for the secondary color formed by the dash of the first color and the dash of the second color separated by the predetermined offset distance.

* * * * *